US006000678A

United States Patent [19]

Coakley

[11] Patent Number: 6,000,678

[45] Date of Patent: Dec. 14, 1999

[54] MOTOR/SPOOL INTERFACE FOR DIRECT DRIVE SERVOVALVE

[75] Inventor: Kim Coakley, Valencia, Calif.

[73] Assignee: H.R. Textron Inc., Valencia, Calif.

[21] Appl. No.: 09/170,134

[22] Filed: Oct. 12, 1998

[51] Int. Cl.[6] ..... F15B 13/044

[52] U.S. Cl. ..... 251/129.11; 137/625.65

[58] Field of Search ..... 137/625.65; 251/129.11

[56] References Cited

U.S. PATENT DOCUMENTS

| | | | |
|---|---|---|---|
| 2,697,016 | 12/1954 | Spurgeon . | |
| 2,769,943 | 11/1956 | Matthews . | |
| 3,550,631 | 12/1970 | Vanderlaan et al. . | |
| 4,197,474 | 4/1980 | Honigsbaum . | |
| 4,339,737 | 7/1982 | Meyers et al. . | |
| 4,452,423 | 6/1984 | Beblavi et al. . | |
| 4,641,812 | 2/1987 | Vanderlaan et al. . | |
| 4,645,178 | 2/1987 | Martin et al. . | |
| 4,793,337 | 12/1988 | Freeman et al. . | |
| 5,040,568 | 8/1991 | Hair et al. . | |
| 5,052,441 | 10/1991 | Hair et al. . | |
| 5,263,680 | 11/1993 | Laux | 251/129.11 |
| 5,263,681 | 11/1993 | Laux | 251/129.11 |

*Primary Examiner*—Gerald A. Michalsky
*Attorney, Agent, or Firm*—Fulbright & Jaworski L.L.P.

[57] ABSTRACT

A direct drive servo valve including a motor having a shaft terminating in an engagement member. The engagement member is received within an opening defined by an engineering plastic material which is coupled to a valve member. The valve member is caused to reciprocate by rotation of the shaft of the motor to control the flow of fluid underpressure from a source thereof to output ports which are in turned coupled to a load.

9 Claims, 3 Drawing Sheets

MOTOR/SPOOL INTERFACE FOR DIRECT DRIVE SERVOVALVE

FIELD OF THE INVENTION

This invention relates to direct drive valves and more particularly to a direct drive valve in which rotational motion of a motor rotor is converted into linear motion of a spool valve and more specifically to the coupling between the rotor and the spool valve.

BACKGROUND OF THE INVENTION

Torque motor driven spool valves are well known in the art including such valves which operate through the utilization of a rotary torque motor having a drive member extending from the rotor thereof into contact with the spool valve to directly reciprocate the spool valve within a bore provided in the valve housing. Typically the spool valve is constructed of 440*c* stainless steel and the drive member is tungsten carbide. When the spool valve reciprocates it controls the flow of fluid from a source thereof to a load in response to the electrical signals applied to the drive motor.

Direct drive servovalves of the type above mentioned are illustrated in the following U.S. Pat. Nos. 2,697,016, 2,769,943, 3,550,631, 4,339,737, 4,197,474, 4,452,423, 4,641,812, 4,645,178, 4,793,337, 5,052,441 and 5,040,568.

In all such direct drive servovalves the spool valve is reciprocated by the free end of the motor shaft contacting the spool through an eccentrically mounted pin having a substantially spherical drive tip. The drive tip may be formed with flat surfaces thereon if desired. The drive tip is inserted into a well or annular groove formed in the spool. The dimensional relationship between the spherical drive tip and the spool is such as to provide minimal frictional forces and near zero backlash. Utilizing such dimensions necessitates lapping and fitting operations which add greatly to the expense of such devices.

As one means of simplifying the construction and operation of such valves, motor to spool couplings as illustrated and described in U.S. Pat. Nos. 5,263,860 and 5,263,861 were made. U.S. Pat. No. 5,263,860 discloses an intricately shaped coupling including a molded plastic member having three fingers which engage a pin extending from the motor shaft. The pin is press fitted into engagement with the fingers and causes the fingers to outwardly expand. U.S. Pat. No. 5,263,861 discloses a brass two piece bushing having an "0" ring encircling it. A pin extending from the motor shaft is inserted into the bushing causing the two halves to separate slightly against the compression force of the "0" ring. Each of these structures operate excellently for the purpose intended but are still some what complex and costly to manufacture.

SUMMARY OF THE INVENTION

In accordance with the present invention there is provided a direct drive valve which includes a valve driven by a motor having a stator and rotor. A shaft is carried by the rotor and has a distal end which is received within an opening provided in a cylindrical sleeve formed of molded plastic. Means for coupling the cylindrical sleeve to the valve is provided. There is an interference fit between the sleeve and the distal end of the shaft.

DETAILED DESCRIPTION 5

Figure 1:
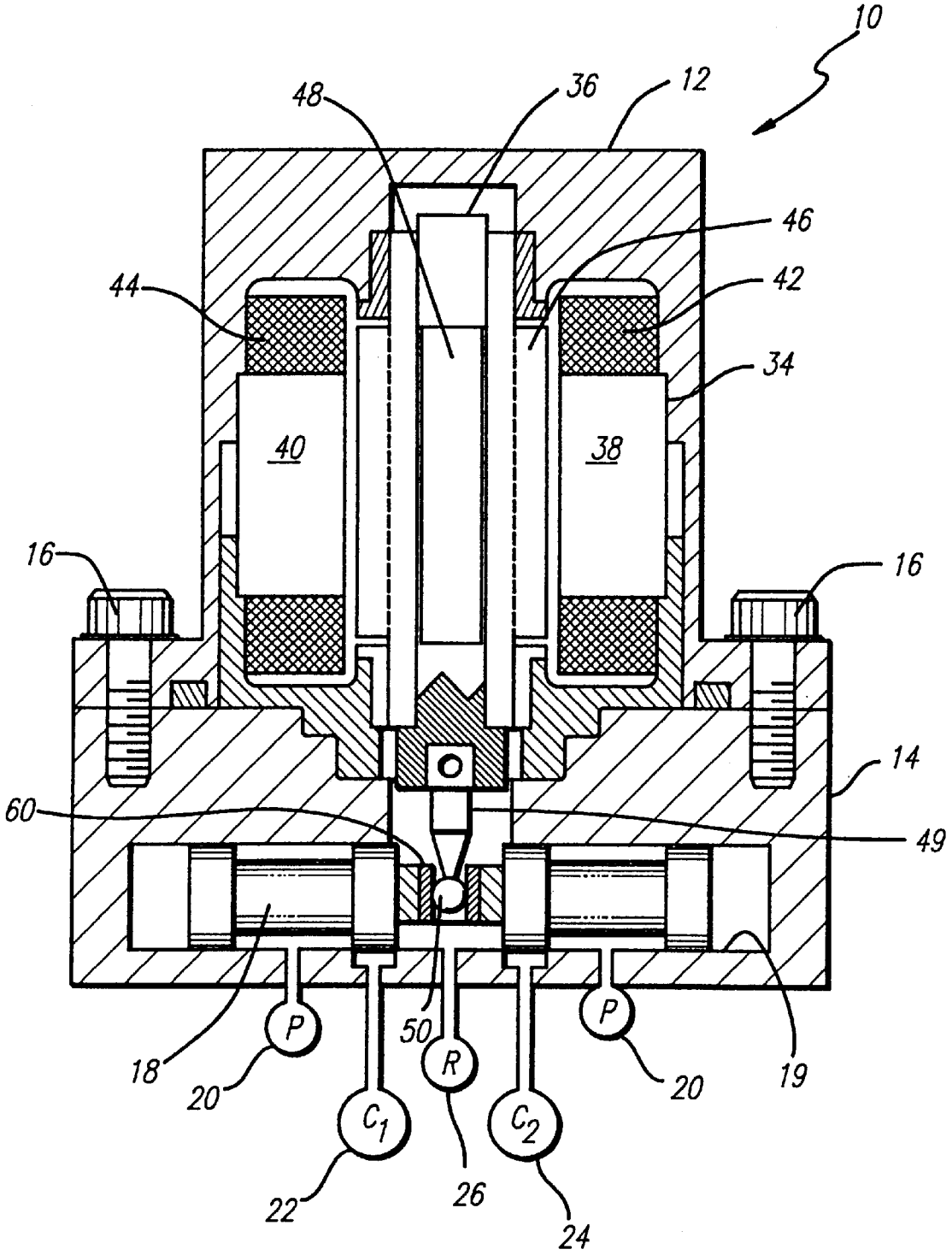
FIG. 1 is a cross-sectional view of a direct drive valve constructed in accordance with the principles of the present invention.

Referring now more specifically to FIG. 1, there is shown a preferred embodiment direct drive valve 10 constructed in accordance with the principles of the present invention. As is therein shown, the valve 10 includes a motor 12 which may be attached to a housing 14 by fasteners such as bolts 16 as is well known to those skilled in the art. A reciprocal valve means is shown generally as a spool valve disposed within a bore 19 within the housing 14. As the spool valve 18 reciprocates within the bore, it controls the flow of fluid under pressure from a source 20 thereof to outputs 22 and 24 for connection to and the control of a load apparatus (not shown). Appropriate ports are provided in the bore 19 for communication with the outputs 22 and 24 as well as the source of fluid 20 and the return 26.

The spool 18 is reciprocated within the bore 19 to meter the flow of fluid as is well known to those skilled in the art. The reciprocation of the spool 18 is accomplished through appropriate coupling to the motor 12. The motor 12 includes a stator 34 and a rotor 36. The stator 34 includes magnetic pole pieces 38 and 40 and drive windings 42 and 44. These drive windings are connected to receive an electrical drive signal from an external source (not shown). This electrical drive signal controls the positioning of the spool 18 in a manner to be described below.

The drive motor 12 rotor includes permanent magnets 46 carried on a shaft 48 which is supported by appropriate bearings as is well known to those skilled in the art. The shaft 48 includes a distal end 49 terminating in an engagement member in the form of a sphere or ball 50, preferably constructed from tungsten carbide or stainless steel, extending therefrom. The ball 50 is eccentrically disposed with respect to the center line of the shaft 48. The ball 50 is coupled to the spool valve 18.

The spool valve carries a cylindrical sleeve 60 which in turn receives the ball 50 in driving engagement. Thus the means for coupling the motor to the valve is an opening directly into the center of the valve. By reference to FIGS. 3 and 6 the cylindrical sleeve 60 is illustrated in further detail. As is therein shown the sleeve 60 has an outer surface 62 and an inner surface 68. The outer surface 62 defines a pair of grooves 64 and 66 which effectively define lands 70, 72 and 74. The lands 70, 72 and 74 engage the inner surface of the spool valve 18. The grooves 64 and 66 carry an adhesive such as an epoxy resin which is utilized to secure the cylindrical sleeve 60 in place within the spool valve 18. The sleeve 60 is split as is shown at 76 and also defines a beveled edge 78 and 80 at the top and bottom thereof as viewed in FIGS. 3 and 6.

The split 76 along with the beveled edges 78 and 80 function to permit the sleeve 60 to be more readily and easily inserted within the spool valve 18. The inner diameter of the opening in the spool valve 18 is slightly less than the outer diameter of the sleeve 60, thus to be inserted, the sleeve 60 may be constricted and then inserted into the opening provided in the spool valve 18. The beveled edge 78 or 80, as the case may be, allows for easier insertion of the cylindrical sleeve 60 into the opening in the spool valve 18. In addition, the split 76 also accommodates the difference between the metallic spool valve 18 and the sleeve 60 insofar as the coefficient of thermal expansion and contraction is concerned.

The cylindrical sleeve 60 is manufactured from an engineering resin which has high performance characteristics. The most critical of these characteristics is that it has a low modulus of elasticity, typically $1\times10^5$ to $2\times10^6$ psi, a low coefficient of friction, and high wear resistance. Lubricants (such as graphite or molybdenum disulfide) can be added to the resins to lower the coefficient of friction and increase the wear resistance of the sleeve 60. The plastic material from which the sleeve 6O is formed most preferably is such that it may be injection molded to provide the configuration desired for the sleeve. Usually such engineering plastics are lighter in weight and are strength competitive with metals. Also, such plastics are capable of operating at relatively high temperatures on the order of 450° F. to 500° F.

Examples of resins which may be utilized to provide the cylindrical sleeve 60 are polyphenylen sulfide polyamide-imide and polyimide. The presently preferred engineering molding resin is a polyamide sold by the DuPont Company, polymer products department at Willmington, Delaware under the trademark VESPEL. Another preferred engineering molding resin is a polyamide-imide polymer sold by Amoco Chemicals Corporation of Chicago, Illinois under the trademark TORLON.

The low coefficient of friction of these materials provides an inherent lubricity which functions to allow an interference fit between the spherical ball 50 at the end of the motor shaft and the internal surface 68 of the sleeve 60. Typically in prior art structures the ball and an opening in the fitting or the spool had to be lapped to provide a clearance of 0 to 0.00005 inches for proper operation. When utilizing a plastic cylindrical sleeve in accordance with the principles of the present invention, such critical dimensioning and expensive manufacturing procedures may be eliminated. In accordance with the presently preferred manufacturing procedures the cylindrical sleeve is inserted along with the adhesive into it's receptacle. After such insertion the internal surface 68 is reamed to the desired size to receive the spherical ball. Typically, the reamed diameter of the inner surface 68 is such as to be slightly smaller than the outer diameter of the spherical ball, thus providing zero to an interference fit of 0.0005 inches. The low modulus of elasticity allows the cylindrical sleeve area on the inner surface 68 which is in contact with the ball to conform to the outer surface of the ball without excessive contact pressure between the two parts. The inherent lubricity of the material in conjunction with the low contact pressure eliminates unwanted threshold characteristics which would occur with a metal to metal interference fit. In addition, the inherent lubricity also permits a coupling of the type disclosed herein to be utilized with other fluids which do not provide lubrication such as water or air.

Figure 2:
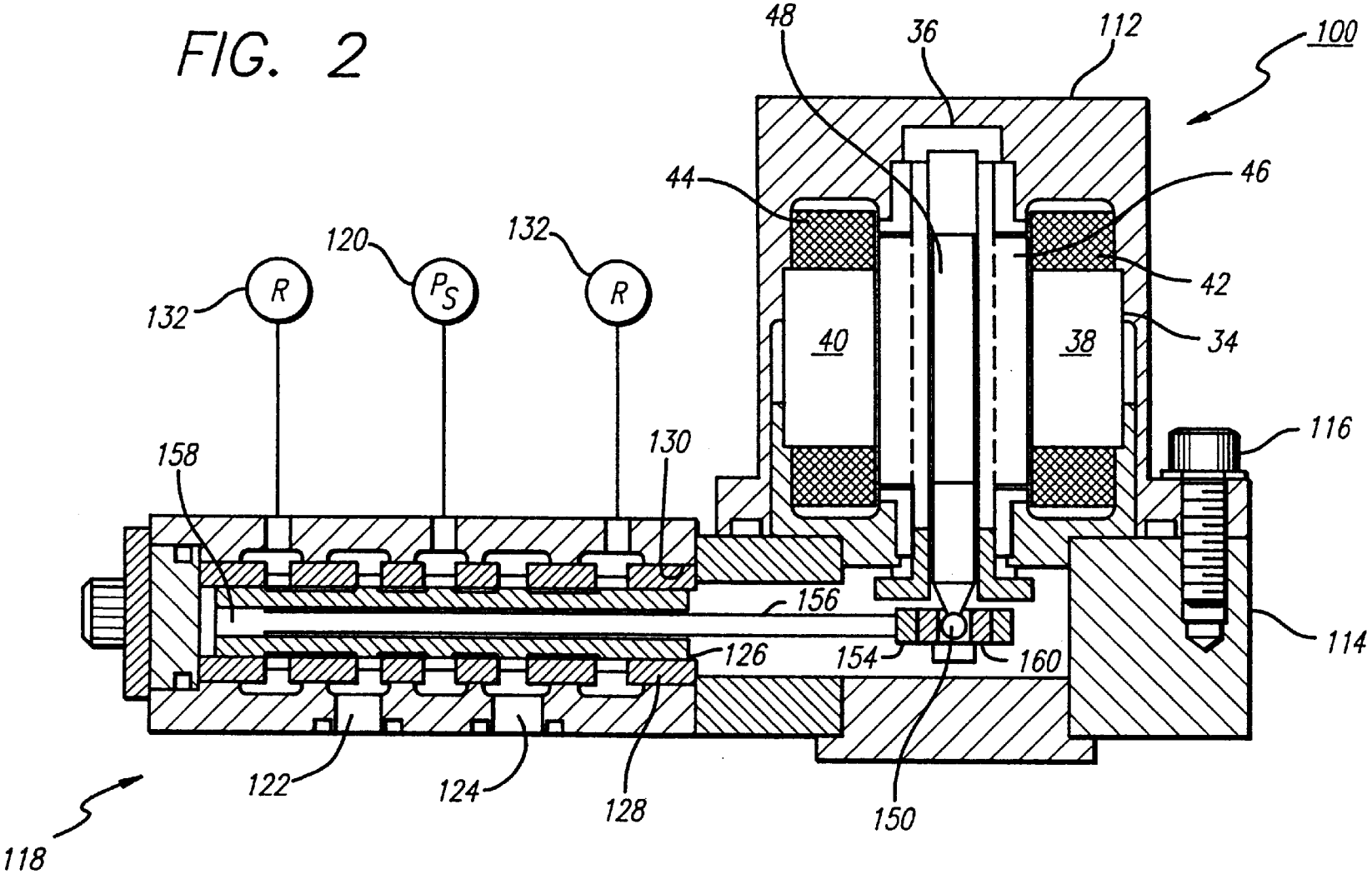
FIG. 2 is a schematic diagram in partial cross-section illustrating an alternative coupling between the rotor shaft and valve.
Figure 4:
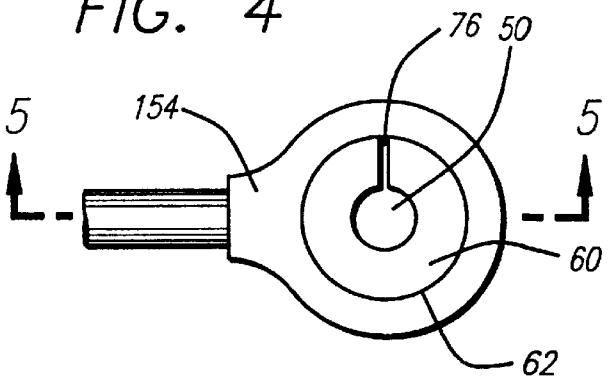
FIG. 4 is a bottom plan view illustrating the coupling between the rotor shaft and valve of FIG. 2.
Figure 5:
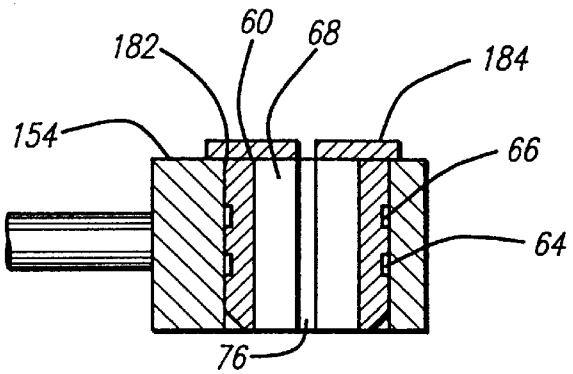
FIG. 5 is a cross-sectional view taken about the lines 5—5 of FIG. 4.

By reference now to FIGS. 2, 4 and 5 there is illustrated an alternative embodiment of a valve constructed in accordance with the principles of the present invention and of means for coupling the cylindrical sleeve to the valve. FIGS. 4 and 5 illustrate in greater detail the structure shown schematically in FIG. 2. As shown in FIG. 2 a valve 100 includes a motor 112 secured to a housing 114 by appropriate fasteners. A 116 valve 118 controls the flow of fluid under 15 pressure from a source 120 to output ports 122 and 124 and to return 132. The valve 118 include a spool 126 reciprocally disposed within a sleeve 128 which has one end there of received within a bore 130 in the housing. A rod 158 has one end thereof secured to one end of the spool 126 and the other end 156 thereof to a fitting 154 which receives a molded pastic sleeve 160. The sleeve 160 receives a ball 150 formed on the distal end of the rotor 36 shaft 48. The motor is the same as that described with respect to FIG. 1 and such is designated by using the same reference numerals.

As is shown in FIGS. 4 and 5 the cylindrical sleeve 60 is inserted into the fitting 154 so that the outer surface 62 thereof is in intimate engagement with the interior surface 82 of the fitting 154. As above indicated the grooves 64 and 66 carry an adhesive such as an epoxy resin which engages the surface 182 of the fitting 154 and when fully set secures the cylindrical sleeve 60 in place within the fitting 154. As above described the sleeve 60 is compressed through the utilization of a jig or fixture so that the split 76 effectively disappears and the sleeve 60 is then inserted into the opening defined by the surface 182 of the fitting 154. The sleeve when inserted is then allowed to expand so that it is in intimate engagement with the inner surface 182 of the fitting 154.

Figure 6:
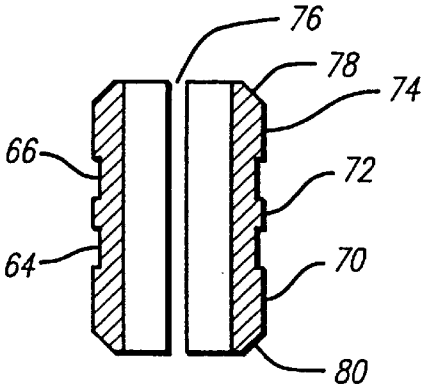
FIG. 6 is a cross-sectional view of the sleeve taken about the lines 6—6 of FIG. 3.
Figure 3:
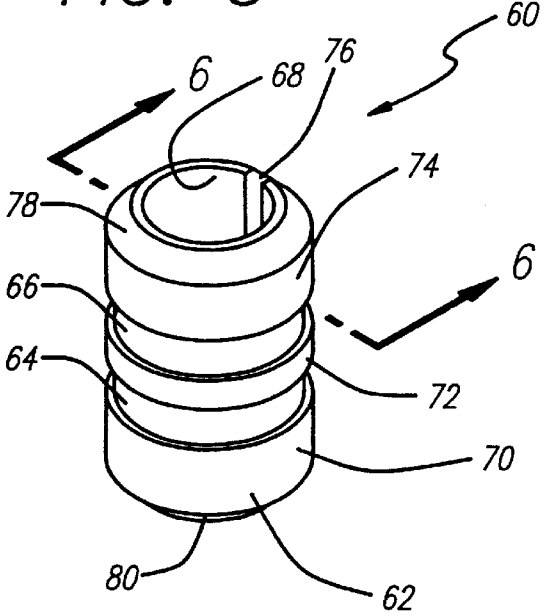
FIG. 3 is a perspective view illustrating one form which a cylindrical sleeve may take.

The cylindrical sleeve may include a radially outwardly extending flange 184 at the top thereof. The utilization of the flange 184 would limit the travel of the sleeve 60 downwardly. The cylindrical sleeve 60 is constructed of the materials as above described and is configured substantially the same as is illustrated in FIG. 3 and 6 with the exception that the upper bevel 78 is replaced by the outwardly extending flange 184. As a result a coupling which functions equally as well if not better than prior art couplings utilizing the lap fit ball and well or slot is provided but at a small fraction of the cost.

What is claimed is:

1. An improved coupling for a rotary-to-linear direct drive valve having a motor including a stator and a rotor and a valve driven by said rotor comprising:

(A) a shaft carried by said rotor and having a distal end in the form of an eccentrically disposed engagement member;

(B) a cylindrical sleeve of plastic material having an inner surface and an outer surface, said plastic material having-a low modulus of elasticity and a low coefficient of friction, said outer surface of said cylindrical sleeve including a plurality of lands separated by grooves, said grooves carrying an adhesive for securing said cylindrical sleeve to said valve;

(C) means for coupling said sleeve to said valve; and (D) said distal end being received by said inner surface of said sleeve and having an interference fit therewith.

2. An improved coupling as defined in claim 1 wherein said means for coupling includes a surface surrounding and in engagement with said outer surface of said cylindrical sleeve and said adhesive for securing said sleeve to said surface surrounding said sleeve outer surface.

3. An improved coupling as defined in claim 2 wherein said cylindrical sleeve defines a slot therethrough.

4. An improved coupling as defined in claim 3 which further includes beveled outer edges at top and bottom surfaces of said cylindrical sleeve.

5. A direct drive servovalve comprising:

(A) a housing defining a bore therein;

(B) a spool valve disposed in said bore for reciprocation therein, said spool valve defining an opening there-in;

(C) a cylindrical sleeve having an inner surface and an outer surface disposed within said opening, said sleeve being formed of engineering plastic material having a low modulus of elasticity and a low coefficient of friction;

(D) a drive motor mounted on said housing and including a rotor having a shaft and an eccentrically disposed ball extending from said shaft, said ball being received within said sleeve for reciprocally driving said spool valve, said ball having an interference fit with said inner surface of said sleeve.

6. A direct drive servovalve as defined in claim 5, wherein said outer surface of said cylindrical sleeve includes a plurality of lands separated by grooves, said grooves carrying an adhesive for securing said cylindrical sleeve to said spool valve.

7. A direct drive servovalve as defined in claim 6 wherein said cylindrical sleeve defines a slot therethrough.

8. A direct drive servovalve as defined in claim 7 wherein said cylindrical sleeve includes beveled outer edges at top and bottom surfaces thereof.

9. A direct drive servovalve as defined in claim 7 wherein said cylindrical sleeve further includes a radially outwardly extending flange at one end thereof.

* * * * *